US008173589B2

(12) United States Patent
Culver et al.

(10) Patent No.: US 8,173,589 B2
(45) Date of Patent: May 8, 2012

(54) LOW ENERGY METHODS OF MAKING PEARLESCENT FABRIC SOFTENER COMPOSITIONS

(75) Inventors: Gayle Elizabeth Culver, Lawrenceburg, IN (US); Jeffrey Frank Omnitz, Cincinnati, OH (US); Francesc Corominas, Grimbergen (BE); Connie Lynn Sheets, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 209 days.

(21) Appl. No.: 12/726,419

(22) Filed: Mar. 18, 2010

(65) Prior Publication Data

US 2011/0230388 A1 Sep. 22, 2011

(51) Int. Cl.
*C11D 1/62* (2006.01)

(52) U.S. Cl. ..... 510/515; 510/287; 510/308; 510/322; 510/327; 510/329; 510/330; 510/394; 510/504

(58) Field of Classification Search ..... 510/287, 510/308, 322, 327, 329, 330, 394, 504, 515
See application file for complete search history.

(56) References Cited

U.S. PATENT DOCUMENTS

| | | | | |
|---|---|---|---|---|
| 4,450,714 | A | 5/1984 | Prohaska et al. | |
| 4,621,023 | A | 11/1986 | Redziniak et al. | |
| 4,767,547 | A | 8/1988 | Straathof et al. | |
| 4,895,452 | A | 1/1990 | Yiournas et al. | |
| 5,380,089 | A | 1/1995 | Karasawa et al. | |
| 5,460,736 | A | 10/1995 | Trinh et al. | |
| 5,474,690 | A | 12/1995 | Wahl et al. | |
| 5,545,340 | A | 8/1996 | Wahl et al. | |
| 5,545,350 | A | 8/1996 | Baker et al. | |
| 5,562,849 | A * | 10/1996 | Wahl et al. | 510/521 |
| 6,369,025 | B1 * | 4/2002 | Trinh et al. | 510/515 |
| 2002/0025915 | A1 * | 2/2002 | Franklin et al. | 510/515 |
| 2004/0204337 | A1 | 10/2004 | Corona | |
| 2006/0264352 | A1 * | 11/2006 | Sajic et al. | 510/515 |
| 2007/0199157 | A1 | 8/2007 | Torres | |
| 2008/0061459 | A1 | 3/2008 | Nakajima et al. | |
| 2009/0042767 | A1 * | 2/2009 | Gizaw et al. | 510/527 |
| 2009/0054296 | A1 | 2/2009 | Mohammadi | |
| 2009/0054297 | A1 | 2/2009 | Mohammadi | |
| 2009/0156455 | A1 * | 6/2009 | Corominas | 510/516 |
| 2011/0124548 | A1 * | 5/2011 | Collier et al. | 510/527 |
| 2011/0172137 | A1 * | 7/2011 | Corominas et al. | 510/527 |

FOREIGN PATENT DOCUMENTS

| | | | |
|---|---|---|---|
| CA | 2675704 | A1 | 8/2009 |
| WO | WO-2004/014321 | | 2/2004 |
| WO | WO-2009/027265 | A1 | 3/2009 |
| WO | WO-2009/027268 | A1 | 3/2009 |
| WO | 2009/057009 | * | 5/2009 |
| WO | WO-2009/057009 | A1 | 5/2009 |

* cited by examiner

*Primary Examiner* — Charles Boyer
(74) *Attorney, Agent, or Firm* — James F. McBride; Melissa G. Krasovec; Steven W. Miller

(57) ABSTRACT

The present invention relates to low energy (e.g., below 1 J/ml) methods of making pearlescent liquid fabric softener compositions.

5 Claims, 1 Drawing Sheet

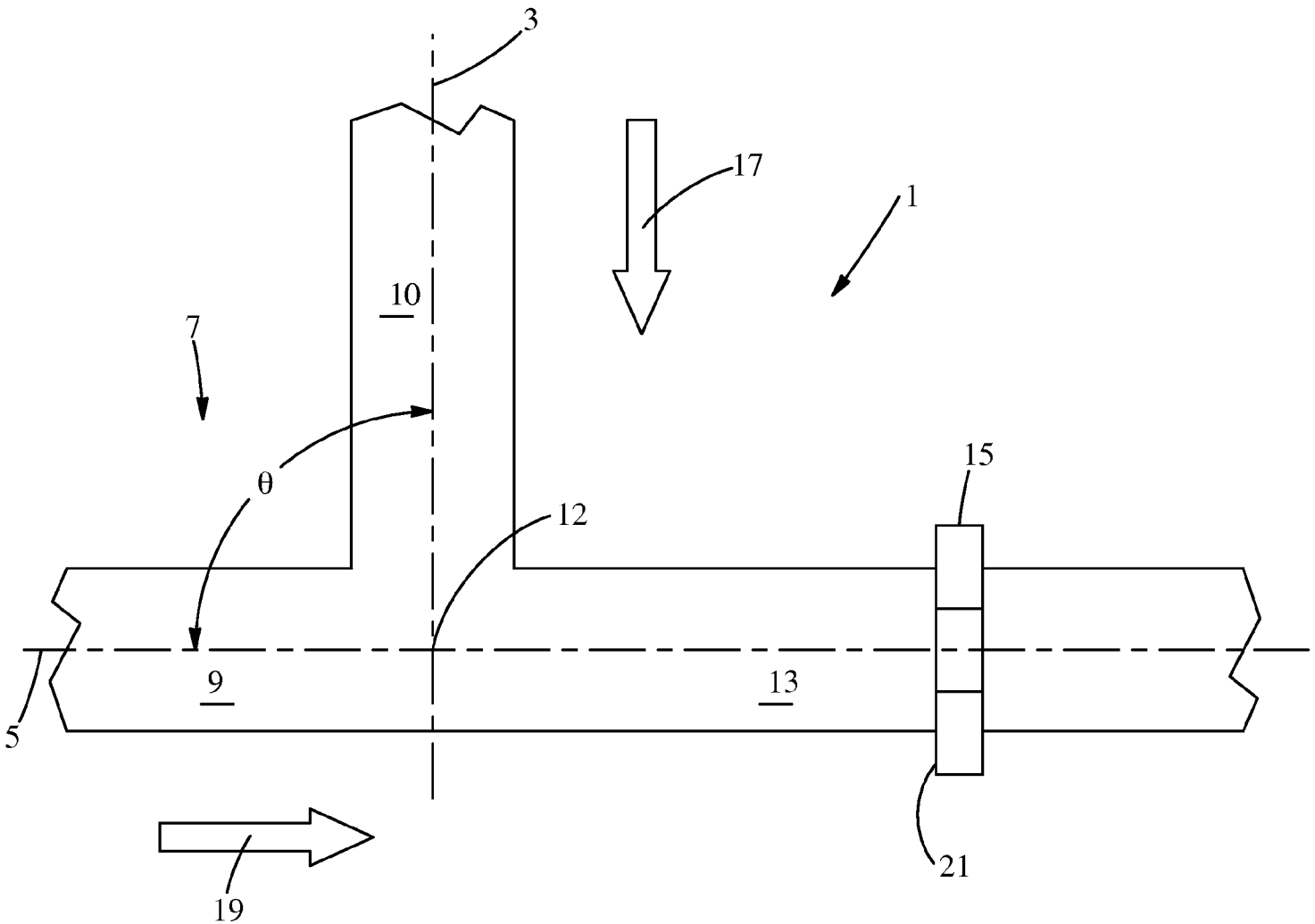
1
3
5
7
9
10
12
13
15
17
19
21
θ

LOW ENERGY METHODS OF MAKING PEARLESCENT FABRIC SOFTENER COMPOSITIONS

FIELD OF THE INVENTION

The present invention relates to methods of making pearlescent fabric softener compositions.

BACKGROUND OF THE INVENTION

Fabric softener compositions having pearlescent or pearl-like appearance have been described. Chemical as well as high power density processing approaches have been described to achieve pearlescent compositions. There is a continuing need to for low cost, low power methods of making pearlescent liquid fabric softener compositions.

See e.g., U.S. Pat. Nos. 4,450,714; 4,621,023; 4,895,452; 5,380,089; US 2009/0156455; US 2008-0061459; US2009/0054296; US 2009/0054297; WO 2004/014321; WO 2007/100669; WO 2009/027268; WO 2009057009A1; EP-B1-0181773; EP-A2-0581193; CA Pat. Publ. No. 2,675,704 A1.

BRIEF DESCRIPTION OF THE DRAWINGS

FIG. 1 is a cross sectional view of the inventive method.

SUMMARY OF THE INVENTION

The present invention attempts to address these and other needs by providing, in a first aspect of the invention, a method of making a pearlescent fabric softener composition comprising the steps: piping water having a temperature from 5° C. to 30° C. through a cold water pipe; piping a fluidized fabric softener active composition at a temperature from 60° C. to 100° C. through a hot active pipe; mixing water received from the cold water pipe and fluidized fabric softener active composition received from the hot active pipe in a mixing zone to form a water/active mixture; and feeding the water/active mixture through an orifice(s) under feed pressure to form the pearlescent fabric softener composition.

Figure

DETAILED DESCRIPTION OF THE INVENTION

Fabric Softener Actives

Fabric softener compositions, such as those sold under the brand name DOWNY and LENOR, typically comprise a fabric softener active. One class of fabric softener actives includes cationic surfactants. Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softener composition (suitable for retail sale) may comprise from about 1% to about 30%, alternatively from about 10% to about 25%, alternatively from about 15 to about 20%, alternatively from about 1% to about 5%, alternatively 17% to 22%, alternatively combinations thereof, of fabric softening active by weight of the final composition. Fabric softener compositions, and components thereof, are generally described in US 2004/0204337. In one embodiment, the fabric softener composition is a so called rinse added composition. In such embodiment, the composition is substantially free of detersive surfactants, alternatively substantially free of anionic surfactants. In another embodiment, the pH of the fabric softening composition is acidic, for example between pH 2 and 5, alternatively between pH 3 and pH 4. In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an aklyating agent. See U.S. Pat. Nos. 4,767,547; 5,460,736; 5,474,690; 5,545,340; 5,545,350; 5,562,849. A suitable supplier of fabric softening active may include Evonik Degussa Corporation.

Pearlescent

"Pearlescent" means any effect comprising shimmer, brilliance, iridescence, glitter, or sparkling. A pearlescent fabric softener is desirable because it may suggest to some consumers a luxurious or high quality product. Without wishing to be bound by theory, a pearlescent composition may be produced by reflection of light. Light is reflected from the plurality of fabric softener active particle as they lie essentially parallel to each other at different levels in the composition to create a sense of depth and luster. Some light is reflected off the particles, and the remainder will pass through the particles. Light passing through the plurality of particles may pass directly through or be refracted. Reflected refracted light produces a different color, brightness, and luster. A "Pearlescence Determination" method is described in US 2009/0156455 A1 at paragraphs [0045] to [0047].

The present invention achieves the desired fabric softener particle structure and thus pearlescent composition, through a manufacturing process that imparts kinetic energy into the system by a confluence of hot active and cold water, and passing the resulting water/active mixture through an orifice. FIG. 1 is a non-limiting example of the inventive method (1).

In one embodiment, the pearlescent fabric softener compositions of the present invention are free or essentially free of pearlescing chemical agents including inorganic natural substances, such as mica, bismuth oxychloride and titanium dioxide, and organic compounds such as fish scales, metal salts of higher fatty acids, fatty glycol esters and fatty acid alkanolamides. These chemicals are often expensive a introduce formulation complexity (compatibility etc.). The present invention avoids these problems.

Cold Water

A step in the present method of making a pearlescent fabric softening composition comprising piping cold water through a cold water pipe (9). The cold water pipe (9) may be a 6 inch diameter pipe made of 316 stainless steel having a wall thickness of 0.065 inch. Of course other materials, thickness, and dimensions may be used. The water temperature of the cold water seat is from about 0° C. to about 30° C., alternatively from 5° C. to about 27° C., alternatively from 10° C. to about 25° C., alternatively from 15° C. to about 25° C., alternatively from about 17° C. to about 23° C., alternatively from 19° C. to about 21° C., alternatively about 20° C., alternatively combinations thereof. The water may be optionally chilled to bring the water to the desired temperature. If chilled, the water is chilled before being mixed with hot fabric softener active.

The term "pipe" is used throughout the specification, but should be construed broadly to include any appropriate conduit. A second center line (5) passes through the center of the cold water pipe (9).

In one embodiment, the water is pH adjusted (before being mixed with the hot softener active). The pH may be adjusted to an acidic pH (i.e., less than 7), preferably between 2 and 5, alternatively from 2 to 4, alternatively from 2 to 3, alternatively from 2 to 4, alternatively combinations thereof. The pH may be adjusted, for example, with hydrochloric acid or formic acid.

In another embodiment, salt (e.g., sodium chloride or calcium chloride) is added to the water (before the cold water is mixed the hot softener active). The amount of salt is added such that the final concentration of salt in the fabric softener composition is from 0.01% to about 0.5% salt by weight of the final fabric softener composition. The amount of salt in the cold water may comprises from 100 parts per million (ppm) to 4000 ppm.

Without wishing to be bound theory, its surprisingly observed that adding salt at this early stage in the process provides for better composition rheology control as opposed to adding salt at a later downstream finishing step (e.g., post feeding through an orifice step). Salt is typically added as a finishing step to reduce viscosity of the fabric softener "white base." However, it is observed that adding salt in this traditional manner under this inventive method of making a pearlescent fabric softener composition does not provide the desired rheology range to create an acceptable consumer product. It is surprising observed that adding salt at this early step (i.e., cold water addition) provides a composition that exhibits a consumer acceptable viscosity profile (e.g., 100-400 cps).

TABLE 1

| Examples | $CaCl_2$, ppm | Mill, rpm | Viscosity - at discharge | Viscosity - 1 hr | Viscosity - 3-5 days | Viscosity - 10 wks |
|---|---|---|---|---|---|---|
| 1 | 2054 | no | 490 | 870 | 960 | >5000 |
| 2 | 2054 | 2282 | 320 | 465 | 810 | >5000 |
| 3 | 1000 | 2282 | 275 | 370 | 530 | 2050 |
| 4 | 1000 | 3511 | 185 | 280 | 410 | 795 |
| 5 | 750 | 3511 | 210 | 255 | 330 | 370 |

The data of Table 1 demonstrates that a $CaCl_2$ level below 2,054 ppm (parts per million) provides a fabric softener composition that exhibits an acceptable rheology profile. Five samples are each conducted having the same: fabric softener active and level (14% DEEDMAC); orifice size (3.37 mm diameter); water temperature (15° C.). Viscosity is assessed using a Brookfield™ Viscometer and reported as cps.

In one embodiment, an electrolyte, such as $CaCl_2$, is added to the water, before active addition, such that final finished fabric softener product comprises at or less than 1500 ppm, alternatively less than 1000 ppm, alternatively less than 750, alternatively from about 1500 ppm to about 500 ppm, alternatively combinations thereof.

Hot Active

Another step in the present method of making a pearlescent fabric softening composition comprises piping a hot fabric softener active composition (or simply "hot active") through a hot active pipe (10).

The temperature of the fluidized fabric softener active composition "melt" is from 60° C. to about 100° C., alternatively from 65° C. to 85° C., alternatively from 60° C. to 80° C., alternatively from 65° C. to 75° C., alternatively about 70° C., alternatively combinations thereof. The fabric softener active composition that is received from the supplier is heated to a molten mixture before being piped in the hot active pipe (10). The exact temperature of the active is dependent upon, in part, on the melting point of the active and a generalized desire to not subject the active to too high temperatures that may result in the degradation and financial costs associated with heating. In one embodiment, the fabric softener active composition (or "hot active") comprises at least 50%, alternatively at least 60%, alternatively at least 70%, alternatively at least 80%, alternatively at least 90%, alternatively from 50% to 100%, alternatively combinations thereof, of fabric softening active by weight of the fabric softener active composition.

The hot active pipe (10) may be a 4 inch diameter pipe made of 316 stain steel having a wall thickness of 0.065 inch. Of course other materials, thickness, and dimensions may be used. The hot active pipe (10) may or may not be heated (to help heat or keep heated the hot active contained herein).

In one embodiment, the diameter ratio between the cold water pipe (9) to the hot active pipe (10) is from about 2:1 to 6:5 respectively, alternatively 3:2, alternatively combinations thereof.

In another embodiment the temperature difference between the cold water being piped in the cold water pipe (9) and that of hot active being pipe in the hot active pipe (10) is at least 30° C., alternatively is at least 35° C., alternatively is at least 40° C., alternatively is at least 50° C., alternatively is at least 55° C., alternatively is at least 60° C., alternatively from 30° C. to about 60° C., alternatively from 40° C. to about 60° C., alternatively from 45° C. to about 60° C., alternatively from 45° C. to about 55° C., alternatively combinations thereof. Without wishing to be bound by theory, the temperature differential between the cold water seat and the hot fabric softener active composition helps to drive the microstructure necessary for the desired pearlescence. In one embodiment this temperature differential is at least 20° C., alternatively at least 30° C., alternatively at least 40° C., alternatively at least 50° C., alternatively at least 60° C.

Confluence

Angle theta (7) describes the angle between the first center line (3) and the second center line (5). Angle theta (7) is shown at 90 degrees in FIG. 1; but angle theta (7) may be, in one embodiment, from 45 degrees to 135 degrees, alternatively from 60 degrees to 120 degrees, alternatively from 80 degrees to 100 degrees, alternatively combinations thereof. The direction (17) of the hot active through the hot active pipe (10) is toward the center line intersection (12). The direction (19) of the cold water flow through the cold water pipe (9) is also toward the center line intersection (12). The mixing chamber (13) is downstream of the center line intersection and the orifice (15) is downstream of the mixing chamber (13).

Without wishing to be bound by theory, this angled confluence of the hot active and cold water may impart some of the kinetic energy necessary to drive pearlescent microstructure of the fabric softener compositions.

Mixing Chamber

Another step in the present method of making a pearlescent fabric softening composition comprises mixing water (received from the cold water pipe (9)) and hot active (received from the hot active pipe (10)) in a mixing zone (13) to form a water/active mixture.

The mixing chamber (13) is the area of piping from the centerline intersection (12) to the upstream side (21) of the orifice (15). This distance is 11.75 inches in FIG. 1, but it can be from about 5 inches to 28 inches, alternatively 6 inches to 20 inches, alternatively 8 inches to 14 inches, alternatively from 10 to 19 inches, alternatively combinations thereof. In FIG. 1, the mixing chamber is essentially an extension of the cold water pipe (10) having the same diameter, thickness, and material as previously described for the cold water pipe (10). Of course other materials, thickness, and dimensions may be used. Without wishing to be bound by theory, the mixing chamber allows the hot active and cold water to interact before being subjected to the orifice.

Orifice

Another step in the present method of making a pearlescent fabric softening composition comprises feeding the water/active mixture through an orifice under feed pressure to extrude the pearlescent fabric softener composition. The orifice may have a circular or polygonal cross section. When polygonal, it is preferred to have a regular polygonal cross section. "Regular polygonal" means each side of the polygon has the same dimension and each side of the polygon is connected to each other by the same angle. Examples of polygons include those having 3, 4, 5, 6, 7, 8, 9, 10, 11, 12 or more sides. In one embodiment, the orifice may be a "dynamic orifice" as described in the US equivalent patent publication of CA 2 675 704 A1. A dynamic orifice may be obtained from Emile Egger & Company Ltd, Pump and Machine Manufacturer, Route de Neuchatel 36, CH-2088 Cressier/NE, Switzerland, IRIS Diaphram Control Valve-BS.

The cross sectional area of the orifice may range from about 2 $mm^2$ to about 2500 $mm^2$. Generally the smaller the cross sectional area of the orifice, the greater the kinetic energy density is imparted to the water/active mixture being extruded. In one embodiment, the orifice has a regular hexagonal cross section having a width measure from side-to-side (perpendicular to the flow mixture through the orifice) from about 25 mm to about 45 mm, alternatively from about 15 mm to about 55 mm, alternatively combinations thereof. The orifice may have thickness from about 5 mm to about 15 mm, alternatively from about 8 mm to about 12 mm, alternatively combinations thereof.

The feed pressure may be from about 34.5 kPa to about 1200 kPa, alternatively from about 50 kPa to about 1,000 kPa, alternatively from about 100 kPa to about 500 kPa, alternatively from about 250 kPa to about 750 kPa, alternatively combinations thereof.

The pressure difference between the feed pressure of the water/active mixture immediately before going through the dynamic orifice and immediately after going through the orifice is from about 1 psid (pounds per square inch) to about 100 psid, alternatively from about 25 psid to about 75 psid. Without wishing to be bound by theory, a change in the opening (holding feeding pressure constant) will generally change kinetic energy densities (but obviously not under all conditions).

The dimension of the pipe downstream of the orifice can be the same or different from the dimensions of the pipe comprising the mixing chamber.

Milling

Another potential step in the present method of making a pearlescent fabric softening composition comprises milling the composition after the extruding step. Preferably an in-line mill is used. Without wishing to be bound by theory, milling may reduce the length of any laminar sheets in the composition with an objective to reduce viscosity. A non-limiting example of milling equipment may include an IKA Dispax Reactor.

Microstructure

The method described herein provides a fabric softener composition comprising active particles having a suitable microstructure to exhibit a pearlescent composition. These active particles, in one embodiment, have an average size ranging from 0.1 to 50 μm. The Dynamic Light Scattering Method measures the average diameter of the particles by light scattering data techniques, which is an intensity-weighted average diameter. One suitable machine to determine the average diameter is a Brookhaven 90Plus Nanoparticle Size Analyzer.

Energy Density

The liquid fabric softener compositions of the present invention require relatively low energy density. One aspect of the invention provides an energy density of less than 1 J/ml, alternatively less than 0.9 J/ml, alternatively less than 0.8 J/ml, alternatively from 0.01 J/ml to 0.9 J/ml, alternatively from 0.02 J/ml to 0.8 J/ml, alternatively 0.025 J/ml to 0.6 J/ml, alternatively from 0.046 J/ml to 0.46 J/ml. Low energy methods are desirable since generally it requires less expensive capital and generally use less electricity to operate.

Energy density is described in 2009/0156455 A1 paragraph [0068]. Power density is described in 2009/0156455 A1 at paragraphs [0069] to [0071].

EXAMPLES

Various concentrations of pearlescent fabric softening compositions are made. Water is piped in the cold water pipe at 20° C. Active in the form of DEEDMAC at a concentration of X % by weight of the fabric softening active composition is piped in the active pipe at a temperature at 75° C. The two pipes confluence at a theta angle of 90 degrees. The upstream side of the orifice is about 11.75 inches from the center line intersection. The orifice has a hexagonal cross section. This cross section is measured from one side of the regular hexagon to the other opposite side, i.e., width of the regular hexagon. In a first example, a 40.31 mm orifice (i.e., the width of the regular hexagon) is used for making the pearlescent fabric softener composition having 10% DEEDMAC (i.e., 10% fabric softening active) by weight of the composition. A flow rate of 1900 lb/min (861.8 kg/min) is used to feed the water/active mixture comprising 10% DEEDMAC through the hexagonal shaped orifice to provide the pearlescent fabric softener composition. In a second example, a 35.35 mm orifice (i.e., the width of the regular hexagon) is used for making a pearlescent softener composition having 12.2% DEEDMAC with a flow rate at 1770 lb/min and 2000 lb/min. In a third example, a 31 mm orifice (i.e., the width of the regular hexagon) is used for making a pearlescent softener composition having 17.3% DEEDMAC with a feed pressure at 30 psid. In a final example, a 25.1 mm orifice (i.e., the width of a the regular hexagon) is used for a pearlescent softener composition having 21.1% DEEDMAC with a flow rate at 1770 lb/min and 2000 lb/min. In one embodiment, the flow rate of the water/active mixture to the orifice is from about 1,000 lb/min to about 3,000 lb/min. The energy densities of the examples are from 0.046 J/ml to 0.46 J/ml.

Adjunction ingredients may be subsequently included including perfume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a pearlescent fabric softener composition at a low energy density is less than 1 J/ml, comprising the steps:

(a) piping water having a temperature from 5° C. to 30° C. through a cold water pipe, (b) piping a fluidized fabric softener active composition at a temperature from 60° C. to about 100° C. through a hot active pipe, wherein the fabric softener active is an ester quaternary ammonium compound having an Iodine Value from 15 to 25;

(c) mixing water received from the cold water pipe and fluidized fabric softener active composition received from the hot active pipe in a mixing zone to form a water/active mixture;

(d) feeding the water/active mixture through an orifice under feed pressure to form the pearlescent fabric softener composition;

wherein the temperature of the fluidized fabric softener active composition piped in the hot active pipe is at least 40° C. higher than the temperature of the water piped in the cold water pipe; and comprising the step of adding $CaCl_2$ to the water before the water is mixed with the fluidized fabric softener active composition, such that the pearlescent fabric softening composition comprises from 500 ppm to 1500 ppm of said $CaCl_2$; and wherein the hot active pipe comprises a first center line and the cold water pipe comprises second center line, wherein the first center line and the second center line form angle theta, and wherein theta is from 45 degrees to 135 degrees.

2. The method of claim 1, wherein the temperature of the water is from 15° C. to 25° C. through the cold water pipe and wherein the Iodine Value of the fabric softener active is from 18-22.

3. The method of claim 2, wherein the water has a pH from 3 to 5.

4. The method of claim 3, wherein the orifice comprises a cross sectional area from 2 $mm^2$ to 2500 $mm^2$.

5. The method of claim 4, wherein the feed pressure is from 34.5 kPa to 1200 kPa.

* * * * *

UNITED STATES PATENT AND TRADEMARK OFFICE

CERTIFICATE OF CORRECTION

PATENT NO. : 8,173,589 B2
APPLICATION NO. : 12/726419
DATED : May 8, 2012
INVENTOR(S) : Culver et al.

It is certified that error appears in the above-identified patent and that said Letters Patent is hereby corrected as shown below:

Column 7
Line 19, between “density” and “is” insert --that--.

Column 8
Line 14, between “comprises” and “second” insert --a--.

Signed and Sealed this
Nineteenth Day of June, 2012

David J. Kappos

David J. Kappos
*Director of the United States Patent and Trademark Office*